US007605809B2

(12) United States Patent
Wey et al.

(10) Patent No.: US 7,605,809 B2
(45) Date of Patent: Oct. 20, 2009

(54) DRIVER AND METHOD FOR DRIVING A SEMICONDUCTOR LIGHT EMITTING DEVICE ARRAY

(75) Inventors: Chinder Wey, Miao-Li (TW); Yi-Chun Yeh, Taipei (TW); Chia-Hung Sun, Kaohsiung (TW); Tsung-Shiun Lee, Tainan (TW)

(73) Assignee: AU Optronics Corp., Hsinchu (TW)

( * ) Notice: Subject to any disclaimer, the term of this patent is extended or adjusted under 35 U.S.C. 154(b) by 269 days.

(21) Appl. No.: 11/407,095

(22) Filed: Apr. 20, 2006

(65) Prior Publication Data

US 2007/0171271 A1 Jul. 26, 2007

(30) Foreign Application Priority Data

Jan. 26, 2006 (TW) ..... 95103050 A

(51) Int. Cl.
*G05G 5/00* (2006.01)

(52) U.S. Cl. ..... 345/212; 345/214; 345/204; 345/211; 345/102; 315/291; 315/312; 315/247; 315/185 S

(58) Field of Classification Search ..... 315/291, 315/307–326, 224, 225, 247, 246, 185 S, 315/200 A; 345/102, 204, 207, 211, 212, 345/214

See application file for complete search history.

(56) References Cited

U.S. PATENT DOCUMENTS 6,515,434 B1 * 2/2003 Biebl ..... 315/291
6,798,152 B2 * 9/2004 Rooke et al. ..... 315/209 R
7,245,089 B2 * 7/2007 Yang ..... 315/307
7,276,861 B1 * 10/2007 Shteynberg et al. ..... 315/291
7,327,337 B2 * 2/2008 Callahan ..... 345/82
2004/0233144 A1 * 11/2004 Rader et al. ..... 345/82
2004/0245946 A1 * 12/2004 Halter ..... 315/312
2004/0251854 A1 * 12/2004 Matsuda et al. ..... 315/291
2007/0114951 A1 * 5/2007 Tsen et al. ..... 315/291
2007/0273681 A1 * 11/2007 Mayell ..... 345/211
2007/0279371 A1 * 12/2007 Lee et al. ..... 345/102

FOREIGN PATENT DOCUMENTS

CN 1397059 A 2/2003
CN 1537403 A 10/2004

* cited by examiner

*Primary Examiner*—Tuyet Vo
(74) *Attorney, Agent, or Firm*—Stout, Uxa, Buyan & Mullins, LLP

(57) ABSTRACT

A driver and method for driving a semiconductor light emitting device array is provided. The driver includes at least one current regulator unit having a plurality of controllable switches to regulate the current of each set of cascaded light emitting devices in the semiconductor light emitting device array. The currents of the sets are used to generate a plurality of feedback signals through a feedback unit. A compensation unit generates a plurality of control signals in response to the feedback signals and a plurality of timing signals, so as to control the controllable switches. A driver according to the present invention can independently and individually control the luminance and timing of each set of cascaded light emitting devices.

24 Claims, 6 Drawing Sheets

DRIVER AND METHOD FOR DRIVING A SEMICONDUCTOR LIGHT EMITTING DEVICE ARRAY

BACKGROUND OF THE INVENTION

1. Field of the Invention

The present invention relates to a driver and method for driving a semiconductor light emitting device array, and more particularly to a driver and method for driving a light emitting diode (LED) array supporting dynamic image control functions.

2. Description of the Prior Art

Light emitting diode (LED) arrays have been gradually employed as the backlight module to a liquid crystal display (LCD). Compared with conventional cold cathode fluorescent lamp (CCFL) backlight modules, the LED arrays are preferable in environmental protection consideration and color brightness performance. The LED backlight module, such as a small size white LED backlight, is generally driven by a constant current controlled by a DC voltage. Another driving type is to use a current sink integrated circuit (IC) to regulate the current flowing through the LEDs of distinct primary colors (that is, red, green, and blue). These conventional driving mechanisms, however, can only achieve a current stability of the entire LED array and the color temperature adjustment in a global sense. Such conventional driving methods still restrain an LED array backlight module from achieving further functions such as dynamic contrast, scanning backlight, and color sequence facility. Therefore, recent efforts have been focused on the improvement about dynamic current stability and color temperature compensation function for the LED backlight modules.

U.S. Pat. No. 6,621,235B2 discloses an integrated LED driving device which employs a single liner regulator and a multiple-output current mirror which is substantially independent of the DC input voltage source and the MOSFET's (Metal Oxide Semiconductor Field Effect Transistor) variation from integration process. Total current through the entire LED array module can be regulated by the MOSFET current mirror and the regulator. The mechanism, however, can only attain global current stability and color temperature of the LED array, but fails to further support advanced functions such as the dynamic contrast adjustment, scanning backlight, and the color sequence facility for the LCD.

U.S. Pat. No. 6,864,867B2 discloses another driving circuit for LED array which comprises a set of switches incorporated with a control loop. This patent focuses on monitoring the total current flowing through the entire LED array, and still fails to attain above advantages when the LED array is employed as a display backlight module.

In view of limitations of prior LED backlight techniques, there is a need to provide an improved driving mechanism to enhance the facility of an LED array module employed as the backlight of an LCD.

SUMMARY OF THE INVENTION

It is an object of the present invention to provide a current driver for driving an LED array, which is employed as a backlight module for a display device such as an LCD, and independently controlling the current flowing through each LED set of cascaded LEDs in the LED array module and thus improving the voltage control range.

It is a further object of the present invention to provide a current driver for driving an LED array, which is employed as a backlight module for a display device such as an LCD, and independently controlling the luminance and timing of each LED set of cascaded LEDs. Accordingly, the current driver of the present invention can replace conventional current regulating circuits, and thus reduce manufacturing cost.

It is another object of the present invention to provide a current driver for driving an LED array, which is employed as a backlight module for a display device such as an LCD, and obtaining more stable current flowing through each LED set of cascaded LEDs comparing with conventional current regulating circuits.

It is yet another object of the present invention to provide a current driver for driving an LED array, which is employed as a backlight module for a display device such as an LCD, and achieving better color gamut quality for the driven LED array.

It is still another object of the present invention to provide a current driver for driving an LED array, which is employed as a backlight module for a display device such as an LCD, and independently controlling the current flowing through the LED sets with different primary colors in an LED array so as to control the local color temperature.

It is yet another object of the present invention to provide an LED current driver capable of accepting image control signals from an application specific integrated circuit (ASIC) so as to independently control the luminance of each individual region in an LED array module, thus a dynamic contrast function can be implemented to achieve a better LCD quality.

It is yet another object of the present invention to provide an LED current driver capable of accepting image control signals from an ASIC so as to independently control on-off timing of each individual region in an LED array module, thus a scanning backlight facility can be achieved to mitigate image blur effect and enhance the contrast.

It is yet another object of the present invention to provide an LED current driver capable of accepting image control signals from an ASIC so as to independently control the on-off timing or frequency of LED sets with different primary colors in an LED array module, thus a color sequence facility can be achieved and the necessity of using color filters may be reduced.

The modularized LED drivers according to one embodiment of the present invention, for example, may be jointly applied to the backlight of a large dimension LCD. The LED driver of the present invention controls the luminance, on-off timing, duty cycle, and frequency of each LED set in an LED array module by using feedback, compensation, as well as regulation techniques. The mechanism disclosed in the present invention will enable a display device, such as an LCD, to accomplish a lot of desired image processing functions. Moreover, the present invention employs active elements and thus can provide faster, stabler, and more accurate dynamic response. The driver in accordance with the present invention includes at least one current regulator unit having a plurality of controllable switches to regulate the current of each set of cascaded light emitting devices in the semiconductor light emitting device array. The currents of the sets are used to generate a plurality of feedback signals through a feedback unit. A compensation unit generates a plurality of control signals in response to the feedback signals and a plurality of timing signals, so as to control the controllable switches.

DETAILED DESCRIPTION OF THE INVENTION

Figure 1:
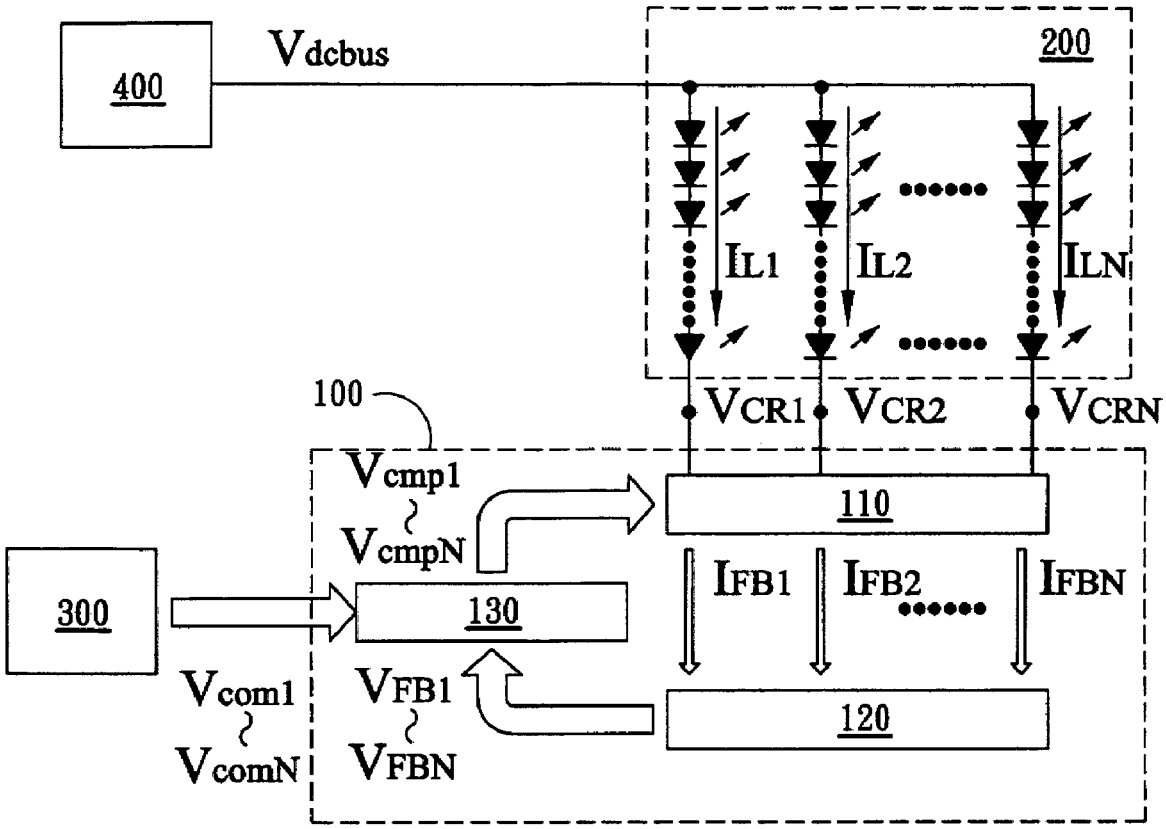
FIG. 1 shows a block diagram of a preferred embodiment of the active current driver of a semiconductor light emitting device array in accordance with the present invention.

FIG. 1 shows a block diagram of a preferred embodiment of the active current driver of a semiconductor light emitting device array according to the present invention. Although light emitting diodes (LEDs) are used in the present embodiment, other light emitting devices may be adaptable. In the present embodiment, the active current driver is utilized to drive an LED array module 200. The active current driver includes an LED active current regulator module 100, a timing control module 300, and a DC supply module 400, in which the LED active current regulator module 100 includes a current regulator unit 110, a feedback unit 120, and a compensation unit 130.

As shown in the figure, the DC supply module 400 is electrically connected to the LED array module 200; the LED array module 200 is connected to the current regulator unit 110; and the timing control module 300 is connected to the compensation unit 130. In the LED active current regulator module 100, the current regulator unit 110 is connected to the feedback unit 120; the feedback unit 120 is connected to the compensation unit 130; and the compensation unit 130 is further connected back to the current regulator unit 110.

Depending on the size of an LCD panel, the LED array module 200 to be driven may include a number of parallel sets of LEDs with each set having cascaded LEDs connected in series as shown in FIG. 1. The quantity of the parallel sets or the quantity of the LEDs in each set may be appropriately adjusted when necessary. White LEDs, red LEDs, green LEDs, blue LEDs, or LEDs packaged with three primary colors (that is red, green, and blue) may be selected for constructing the LED array module 200. For the LED array module 200 as shown, the anode of the first LED in each LED set is connected to receive the output of the DC supply module 400, and the cathode of the last LED in each LED set is connected to the LED active current regulator module 100 at $V_{CR1}$-$V_{CRN}$. The magnitude of current $I_{L1}$-$I_{LN}$ flowing through each LED set and its corresponding luminance and timing control could be independently controlled by the LED active current regulator module 100.

Figure 2:
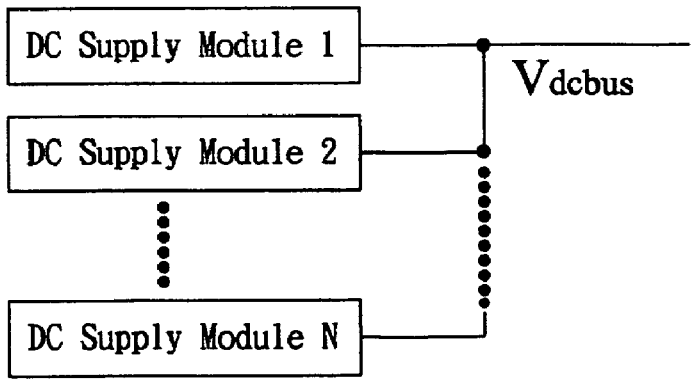
FIG. 2 shows multiple DC supply modules connected in parallel.

The DC supply module 400 transforms power source to a DC voltage level $V_{dcbus}$ and thus provides a stable DC power for the LED array module 200. The transformation in the DC supply module 400 may be a DC-to-DC conversion, an AC-to-DC conversion, or may be achieved by a circuit designed with low dropout voltage regulators, charge pumps, operational amplifiers, or passive elements. Depending on the need of the LED array module 200, the DC supply module 400 may also contain power supply units in parallel arrangement to provide adequate power, as exemplified in FIG. 2.

The LED active current regulator module 100 is controlled by timing signals $V_{com1}$-$V_{comN}$ from the timing control module 300 to carry out actions such as regulating the magnitude of current $I_{L1}$-$I_{LN}$ flowing through each LED set and handling the on-off timing of each LED set. The magnitude of current $I_{L1}$-$I_{LN}$ respectively flowing through each LED set is primarily and independently controlled through the current regulator unit 110, therefore generating feedback currents $I_{FB1}$-$I_{FBN}$. To maintain the stability, the feedback currents $I_{FB1}$-$I_{FBN}$ are converted to feedback signals $V_{FB1}$-$V_{FBN}$ in the feedback unit 120, and then the converted feedback signals $V_{FB1}$-$V_{FBN}$ are applied to the compensation unit 130 which in turn outputs control signals $V_{cmp1}$-$V_{cmpN}$ to the current regulator unit 110 so as to form a close-loop feedback compensation function and obtain desired current magnitude through each LED set and the on-off timing thereof. The active current regulator module 100 in accordance with the present invention may be constructed by active elements and passive elements. Alternatively, it may also be integrated into a single integrated circuit. The active current regulator module 100 may further collaborate with a specific ASIC in an LCD display to perform image processing related functions dynamically so as to improve image frame contrast, alleviate image blur effect, and minimize the necessity of color filters.

Figure 3:
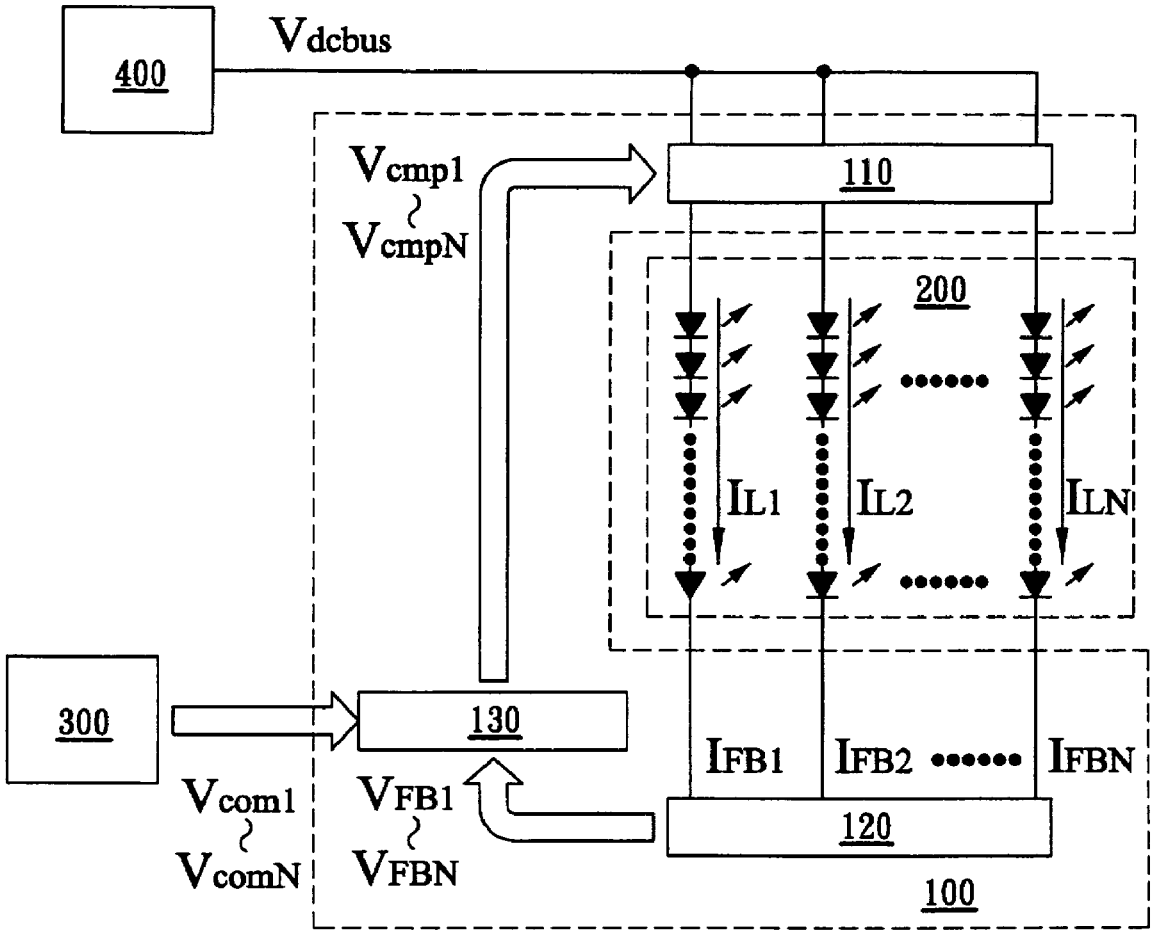
FIG. 3 shows a block diagram of another embodiment of the active current driver of a semiconductor light emitting device array in accordance with the present invention.

FIG. 3 shows a block diagram of another embodiment of the active current driver of a semiconductor light emitting device array in accordance with the present invention. Compared with FIG. 1, the current regulator unit 110 of the LED active current regulator module 100 is connected between the DC supply module 400 and the LED array module 200. Specifically, the current regulator unit 110 is connected to the anodes of the LED array module 200.

Figure 4A:
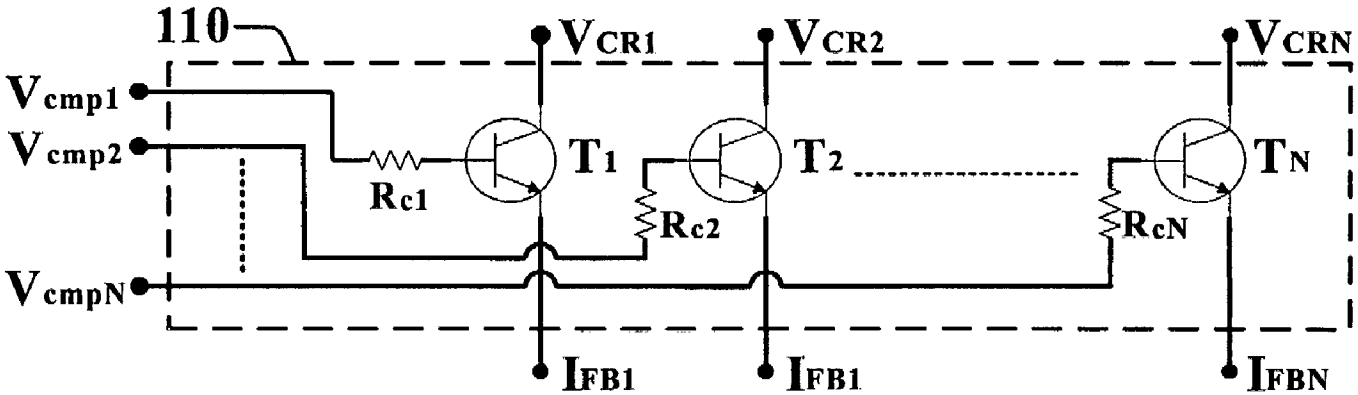
FIG. 4A shows an embodiment of the current regulator unit in accordance with the present invention.
Figure 4B:
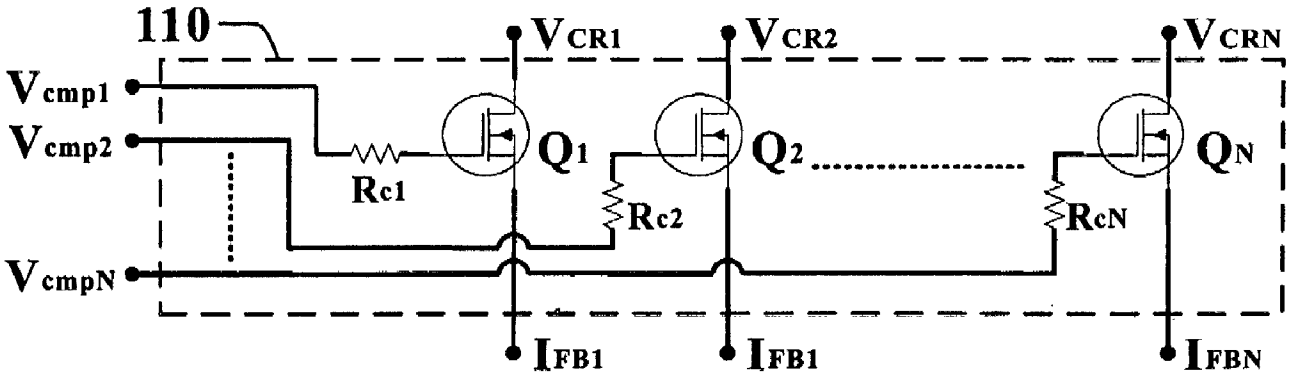
FIG. 4B shows another embodiment of the current regulator unit in accordance with the present invention.
Figure 4C:
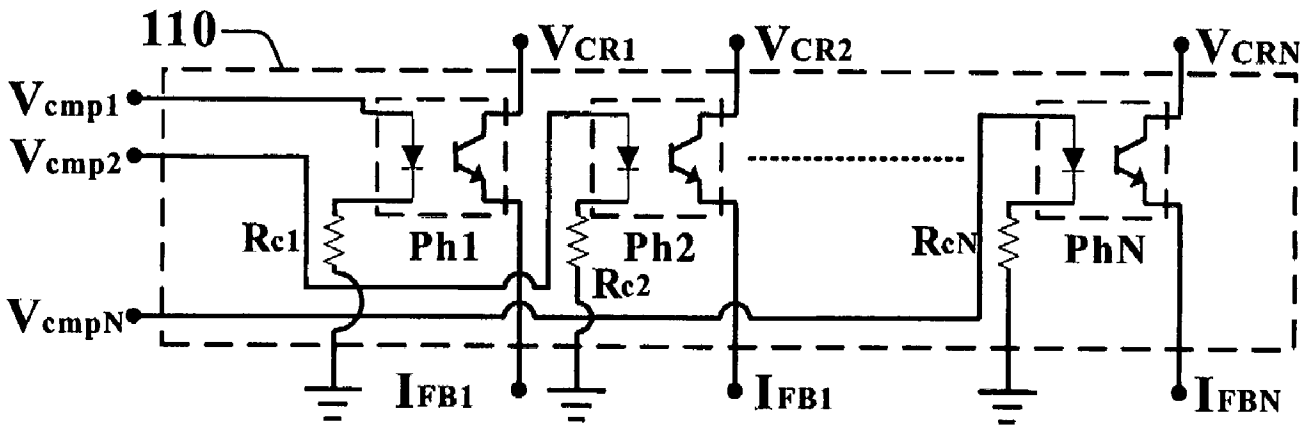
FIG. 4C shows yet another embodiment of the current regulator unit in accordance with the present invention.

The current regulator unit 110 includes multiple controllable switches. Each controllable switch contains at least a control terminal, an input terminal, and an output terminal. Each control terminal is connected to receive control signals $V_{cmp1}$-$V_{cmpN}$ from the compensation unit 130, and the controllable switches control the current flowing through each LED set in response to the control signal $V_{cmp1}$-$V_{cmpN}$. FIG. 4A shows an embodiment of the current regulator unit 110 in accordance with the present invention, which contains controllable switches made of bipolar junction transistors (BJT hereinafter) $T_1$-$T_N$ and resistors $R_{C1}$-$R_{CN}$. Bases of the BJTs $T_1$-$T_N$ respectively receive control signals $V_{cmp1}$-$V_{cmpN}$ from the compensation unit 130 to regulate current flowing through the BJTs $T_1$-$T_N$. Collectors of the BJTs $T_1$-$T_N$ are respectively connected to the cathodes of the LED sets (as shown in FIG. 1) or to the DC supply module 400 (as shown in FIG. 3) so as to control the current magnitude and on-off timing of each LED set. Emitters of the BJTs $T_1$-$T_N$ are respectively connected to terminals of the feedback unit 120 (as shown in FIG. 1) or to the anodes of the LED sets (as shown in FIG. 3) so as to provide the feedback currents $I_{FB1}$-$I_{FBN}$. Because the current regulator unit 110 is directly connected with the LED array module 200, this can obtain a broader current regulating range and a more efficient timing control mechanism. The control signals $V_{cmp1}$-$V_{cmpN}$ applied to the transistors $T_1$-$T_N$ may have simple voltage levels or pulse width modulation signals with varying duty cycles or frequencies. The controllable switches in the current regulator unit 110 may instead be made of other devices. As illustrated in FIG. 4B, another embodiment of the current regulator unit 110 in accordance with the present invention, the controllable switches are made of power metal oxide semiconductor (MOS) transistors $Q_1$-$Q_N$. FIG. 4C shows yet another embodiment of the current regulator unit 110 in accordance with the present invention, in which the controllable switches are made of photo couplers $Ph_1$-$Ph_N$.

Figure 5:
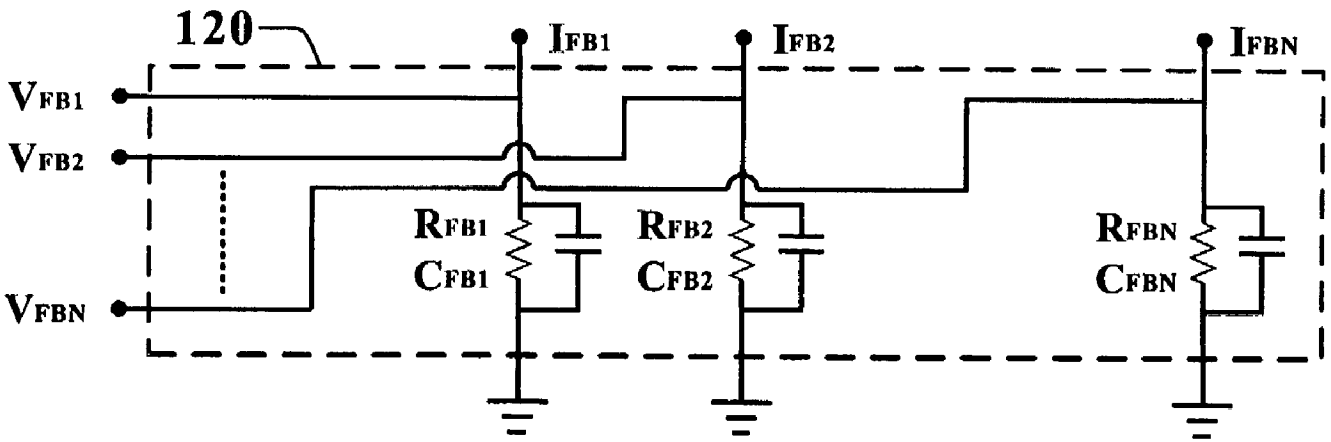
FIG. 5 shows the circuit diagram of an embodiment of the feedback unit in accordance with the present invention.

FIG. 5 shows the circuit diagram of an embodiment of the feedback unit 120 in accordance with the present invention, which includes multiple resistors $R_{FB1}$-$R_{FBN}$ to achieve the feedback function. Each resistor $R_{FB1}$-$R_{FBN}$ may be connected with a capacitor $C_{FB1}$-$C_{FBN}$ in parallel for more accurate feedback control. First terminals of the resistors $R_{FB1}$-$R_{FBN}$ respectively receive feedback current $I_{FB1}$-$I_{FBN}$ from the current regulator unit 110 (as shown in FIG. 1) or from the LED array module 200 (as shown in FIG. 3). The other terminals of resistors $R_{FB1}$-$R_{FBN}$ are grounded. Feedback signals $V_{FB1}$-$V_{FBN}$ converted in the feedback unit 120 are then provided to the compensation unit 130 for compensation operation.

Figure 6A:
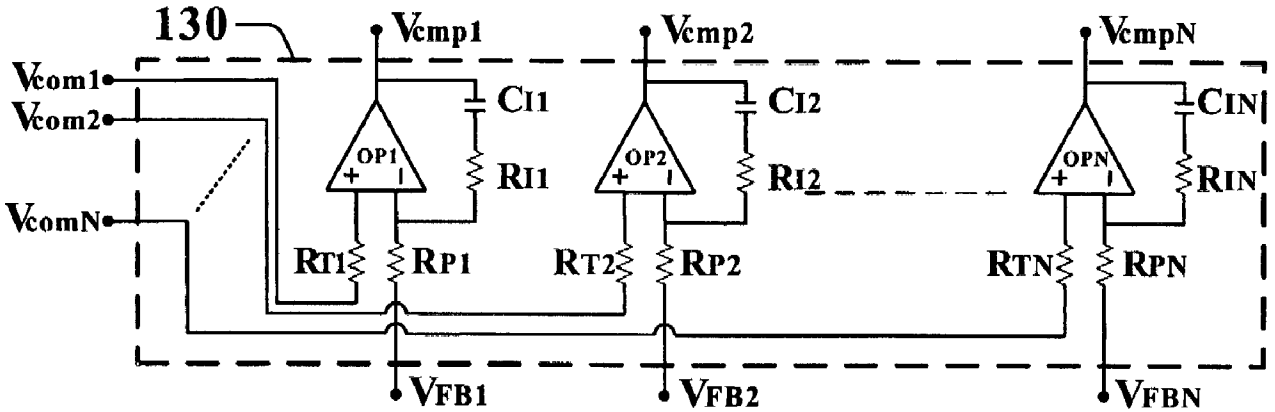
FIG. 6A shows the circuit diagram of an embodiment of the compensation unit in accordance with the present invention.
Figure 6B:
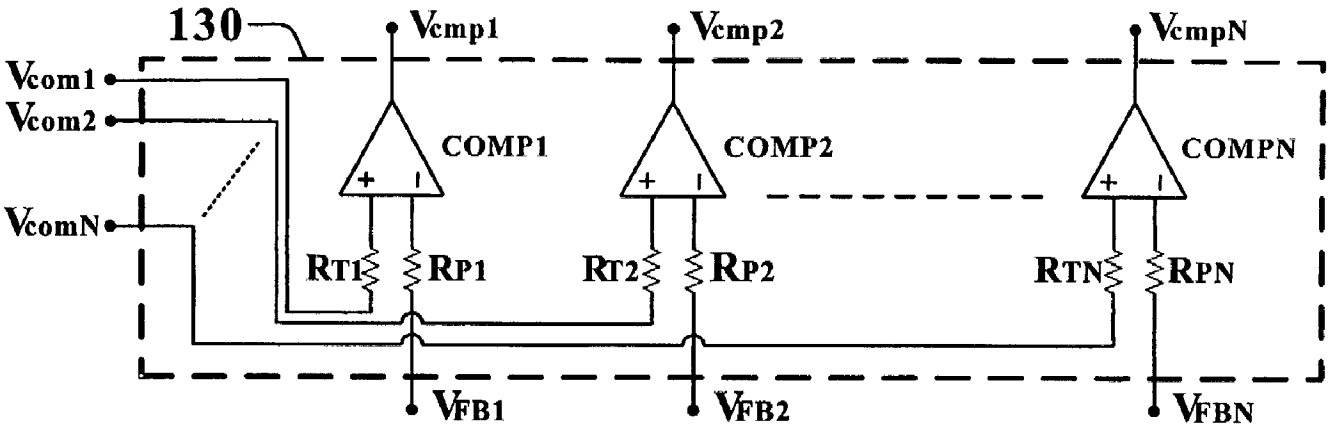
FIG. 6B shows the circuit diagram of another embodiment of the compensation unit in accordance with the present invention.

The compensation unit 130 outputs control signals $V_{cmp1}$-$V_{cmpN}$ to command the current regulator unit 110 to regulate the LED luminance and on-off timing. The control signals $V_{cmp1}$-$V_{cmpN}$ are generated by differential operation or proportional integral compensation of the timing signals $V_{com1}$-$V_{comN}$ from the timing control module 300 and the feedback signals $V_{FB1}$-$V_{FBN}$ from the feedback unit 120. In the present embodiment, the luminance and on-off timing of each LED set in the LED array module 200 is independently controlled by the control signals $V_{com1}$-$V_{comN}$. Moreover, the stability of the current flowing through each LED set can be achieved by the compensation unit 130. FIG. 6A shows the circuit diagram of an embodiment of the compensation unit 130 in accordance with the present invention, which employs operational amplifiers $OP_1$-$OP_N$ and resistors and capacitors to accomplish differential operation and proportional integral function. In the present embodiment, each operational amplifying circuit includes an operational amplifier $OP_i$, a first resistor $R_{Ti}$, a second resistor $R_{Pi}$, a third resistor $R_{Ii}$, and a capacitor $C_{Ii}$, where subscript i represents an integer between 1 and N. One terminal of the first resistor $R_{Ti}$ receives the timing signal $V_{comi}$ from the timing module 300, and the other terminal is connected to the non-inverting input terminal of the operational amplifier $OP_i$. One terminal of the second resistor $R_{Pi}$ receives the feedback signal $V_{FBi}$ from the feedback unit 120, and the other terminal is connected to the inverting input terminal of the operational amplifier $OP_i$. One terminal of the third resistor $R_{Ii}$ is connected to the inverting input terminal of the operational amplifier $OP_i$, and the other terminal is connected to one terminal of the capacitor $C_{Ii}$. The other terminal of the capacitor $C_{Ii}$ is connected to the output terminal of the operational amplifier $OP_i$. If the capacitor $C_{Ii}$ is selectably removed and the other terminal of the third resistor $R_{Ii}$ is thus directly connected to the output terminal of the operational amplifier $OP_i$. Alternatively, the resistors $R_{I1}$-$R_{IN}$ and the capacitors $C_{I1}$-$C_{IN}$ may be selectably removed from the circuit and the operational amplifiers $OP_1$-$OP_N$ thus act as comparators, as shown in FIG. 6B, the circuit diagram of another embodiment of the compensation unit 130 in accordance with the present invention, which includes comparators $COMP_1$-$COMP_N$ and resistors $R_{T1}$-$R_{TN}$ and $R_{P1}$-$R_{PN}$.

Figure 7:
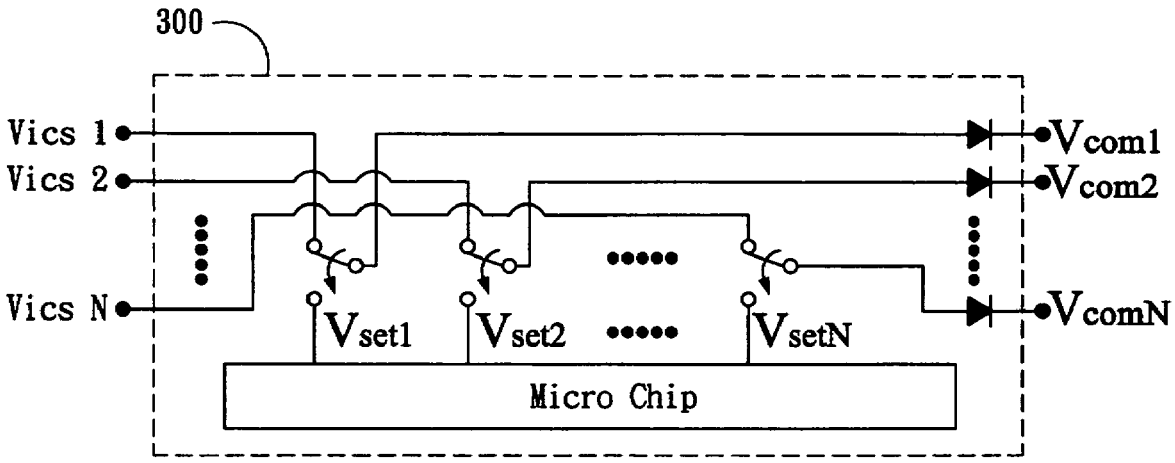
FIG. 7 shows the circuit diagram of an embodiment of the timing control module in accordance with the present invention.

FIG. 7 shows the circuit diagram of an embodiment of the timing control module 300 in accordance with the present invention. The generated control signals $V_{com1}$-$V_{comN}$ are applied to the LED active current regulator module 100 to control the timing and current of each LED set and thus control the on-off timing and luminance of primary RGB colors in the LED array module 200. With the present embodiment, the image quality of an LCD display can be improved by backlight efficiency optimization, alleviating image blur, and enhancing frame contrast without the use of color filters. As can be seen in FIG. 7, through the setting of a selector made of switches, the timing control signals $V_{com1}$-$V_{comN}$ can be selected from either external image control signals $V_{ics1}$-$V_{icsN}$ generated by a previous stage system ASIC or the predetermined timing signals $V_{set1}$-$V_{setN}$ preset inside the module. When the image control signals $V_{ics1}$-$V_{icsN}$ are not available for the timing control module 300, the predetermined timing signals $V_{set1}$-$V_{setN}$ may be employed as the timing control signals $V_{com1}$-$V_{comN}$ for regulating the LED sets in the LED array module 200. The LED array module 200 can adjust the mixed RGB color temperature or white balance according to these signals $V_{set1}$-$V_{setN}$. As soon as the image control signals $V_{ics1}$-$V_{icsN}$ become available, they are employed for RGB primary color dynamic control operation such as scanning backlight and RGB color sequence. The predetermined signal generation circuit inside the timing control module 300 may be constructed by analog circuits or integrated programmable logical devices such as a complex programmable logical device (CPLD), a field programmable gate array (FPGA), or a microchip. The timing control module 300 may be constructed with aforementioned programmable logical devices with or without other passive elements.

Although only some preferred embodiments have been illustrated and described, it will be appreciated by those skilled in the art that various modifications may be made without departing from the scope of the present invention, which is intended to be limited solely by the appended claims.

What is claimed is:

1. A driver for driving a semiconductor light emitting device array, comprising:

a current regulator unit comprising a plurality of controllable switches for regulating current magnitude of each set of cascaded light emitting devices in said semiconductor light emitting device array;

a feedback unit for generating a plurality of feedback signals respectively in response to the current magnitude of each set of the cascaded light emitting devices; and a compensation unit for generating a plurality of control signals to respectively control the controllable switches in accordance with a comparison difference between a plurality of input timing signals and the feedback signals.

2. The driver as claimed in claim 1, wherein each of said controllable switches in said current regulator unit comprises a control terminal, an input terminal, and an output terminal, wherein the control terminal is electrically connected to said compensation unit, the input terminal is electrically connected to said semiconductor light emitting device array, and the output terminal is electrically connected to said feedback unit.

3. The driver as claimed in claim 2, further comprising a power supply module electrically connected to said semiconductor light emitting device array.

4. The driver as claimed in claim 1, wherein each of said controllable switches in said current regulator unit comprises a control terminal electrically connected to said compensation unit and an output terminal electrically connected to said semiconductor light emitting device array.

5. The driver as claimed in claim 4, further comprising a power supply module electrically connected to input terminals of the controllable switches.

6. The driver as claimed in claim 1, wherein said controllable switches in said current regulator unit comprise bipolar junction transistors (BJTs), power metal oxide semiconductor (MOS) transistors, or photo couplers.

7. The driver as claimed in claim 1, wherein said feedback unit comprises a plurality of resistors to convert the current magnitudes to a plurality of voltage magnitudes which are then employed as the feedback signals.

8. The driver as claimed in claim 7, wherein said feedback unit further comprises a plurality of capacitors respectively connected in parallel with the resistors.

9. The driver as claimed in claim 1, wherein said compensation unit comprises a plurality of operational amplifiers, one input terminal of each of the operational amplifiers is adapted to receive one of the timing signals, the other input terminal of each of the operational amplifiers is adapted to receive one of the feedback signals from said feedback unit, and an output terminal of each of the operational amplifiers is adapted to output one of the control signals.

10. The driver as claimed in claim 1, wherein said compensation unit comprises a plurality of comparators, one input terminal of each of the comparators is adapted to receive one of the timing signals, the other input terminal of each of the comparators is adapted to receive one of the feedback signals from said feedback unit, and an output terminal of each of the comparators is adapted to output one of the control signals.

11. The driver as claimed in claim 1, further comprising a timing control module for generating the timing signals.

12. The driver as claimed in claim 11, wherein said timing control module comprises a predetermined voltage generating circuit for generating the timing signals.

13. The driver as claimed in claim 11, wherein said timing control module comprises a selector for selectably receiving a plurality of image control signals to be employed as the timing signals.

14. The driver as claimed in claim 1, wherein said semiconductor light emitting device comprises a light emitting diode (LED).

15. A method for driving a semiconductor light emitting device array, comprising:

(a) providing a plurality of timing signals;

(b) respectively providing a current for each set of cascaded light emitting devices in said semiconductor light emitting device array;

(c) correspondingly generating a plurality of feedback signals in response to magnitude of the currents;

(d) correspondingly generating a plurality of control signals in accordance with a comparison difference between the timing signals and the feedback signals; and (e) independently regulating the magnitude of the current of each said set of cascaded light emitting devices in response to the control signals.

16. The method as claimed in claim 15, further comprising supplying a DC power for said semiconductor light emitting device array.

17. The method as claimed in claim 15, wherein said step (e) comprises respectively electrically connecting the control signals to each base of a plurality of bipolar junction transistors (BJTs), and accordingly regulating the magnitude of currents of said semiconductor light emitting device array through an emitter or a collector of the BJTs.

18. The method as claimed in claim 15, wherein said step (e) comprises respectively electrically connecting the control signals to each gate of a plurality of metal oxide semiconductor (MOS) transistors, and accordingly regulating the magnitude of currents of said semiconductor light emitting device array through a drain or a source of the MOS transistors.

19. The method as claimed in claim 15, wherein said step (e) comprises respectively electrically connecting the control signals to each control terminal of a plurality of photo couplers, and accordingly regulating the magnitude of currents of said semiconductor light emitting device array through an input terminal or an output terminal of the photo couplers.

20. The method as claimed in claim 15, wherein said step (c) comprises respectively inputting the current for each set of cascaded light emitting devices to one of a plurality of resistors, and accordingly converting into the feedback signals.

21. The method as claimed in claim 15, wherein said step (d) comprises respectively inputting the timing signals and the feedback signals to a plurality of operational amplifiers, so as to generate the control signals.

22. The method as claimed in claim 15, wherein said step (d) comprises respectively inputting the timing signals and the feedback signals to a plurality of comparators, so as to generate the control signals.

23. The method as claimed in claim 15, wherein said timing signals in the step (a) are predetermined.

24. The method as claimed in claim 15, wherein said timing signals in the step (a) are provided by inputting external image control signals.

* * * * *

UNITED STATES PATENT AND TRADEMARK OFFICE

CERTIFICATE OF CORRECTION

PATENT NO. : 7,605,809 B2
APPLICATION NO. : 11/407095
DATED : October 20, 2009
INVENTOR(S) : Wey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 452 days.

Signed and Sealed this

Fifth Day of October, 2010

David J. Kappos

David J. Kappos
*Director of the United States Patent and Trademark Office*